US005137157A

United States Patent [19]

Lawson

[11] Patent Number: 5,137,157

[45] Date of Patent: Aug. 11, 1992

[54] CAP HOLDER

[76] Inventor: James D. Lawson, 1562 Ridgewood Rd., Alamo, Calif. 94507

[21] Appl. No.: 569,193

[22] Filed: Aug. 16, 1990

[51] Int. Cl.[5] ..... A47F 7/00
[52] U.S. Cl. ..... 211/32; 211/87
[58] Field of Search ..... 211/13, 41, 32, 87, 211/35, 70.6

[56] References Cited

U.S. PATENT DOCUMENTS

| | | | |
|---|---|---|---|
| 348,983 | 9/1886 | Mack et al. | 211/32 |
| 725,655 | 4/1903 | Beaman | 211/41 X |
| 2,906,406 | 9/1959 | Clark | 211/13 |
| 3,064,823 | 11/1962 | Shock | 211/13 X |
| 4,376,486 | 3/1983 | Arcadi | 211/35 |

*Primary Examiner*—Robert W. Gibson, Jr.

[57] ABSTRACT

A cap holding device having a group of three restraining prongs positioned on a common base.

1 Claim, 1 Drawing Sheet

CAP HOLDER

BACKGROUND OF THE INVENTION

1. Field of the Invention

The invention relates to an improved method for the display and containment of baseball type caps in the home or in business.

2. Description of the Prior Art

The use of baseball type caps is extremely popular with a great number of people who have accumulated an abundance of such caps. This has created a need for a better display and containment arrangement.

Caps are currently displayed and contained by being stacked on shelves, counters, closets, drawers, hat racks, hooks and trays. In selecting a desired cap from among these stacks the other caps are disturbed and must be rearranged. In some cases single hooks are used, but the caps are not sufficiently secured from readily falling off the hook. Another method of display is the use of clips which grip the cap material and which could cause damage to the cap shape. This invention eliminates these problems.

SUMMARY OF THE INVENTION

The invention relates to a rigid device to allow caps to be displayed on any relatively smooth surface. It comprises an inexpensive means for more effective display and containment of baseball type caps.

DESCRIPTION OF THE PREFERRED EMBODIMENTS

Figure 1:
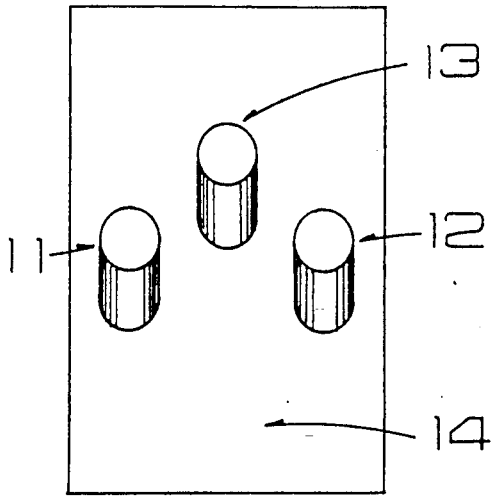
FIG. 1 is a view showing an embodiment of the Cap Holder.
Figure 2:
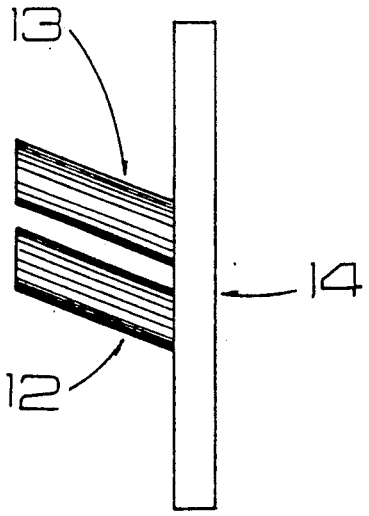
FIG. 2 is the side view of the embodiment of the Cap Holder.
Figure 3:
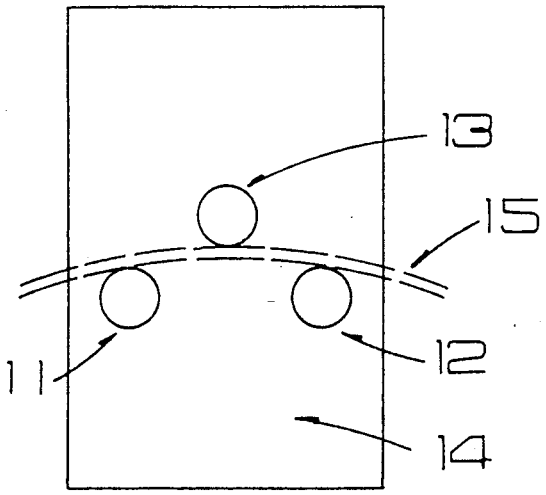
FIG. 3 is a view showing how a rear band of cap is to be positioned on the Cap Holder.
Figure 4:
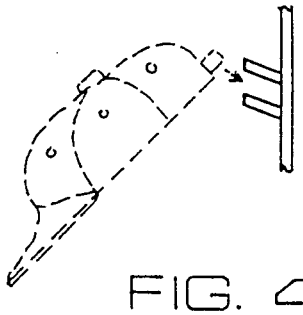
FIG. 4 is a view showing a single Cap Holder with a Cap.

The invention consists of the use of a grouping of three rigid prongs protruding at an angle from the base. With reference to FIGS. 1 and 2, the prongs are spaced so that prongs 11 and 12 are horizontal to each other with prong 13 protruding from the base at a point between prongs 11 and 12 but above them. Thus, when the rear band of cap is placed across prongs 11 and 12, as shown in FIGS. 3 and 4, prong 13 provides sufficient binding power to the cap band 15 against prongs 11 and 12 to hold it in position on the cap holder. This also permits easy placement and removal of the cap from the holder. The base 14 is to be attached to any relatively smooth surface with glue or any other convenient means.

Singly mounted cap holders, each comprising the one group of three prongs, may be positioned to permit any desired display of a large accumulation of caps, or each cap may be displayed individually.

Figure 5:
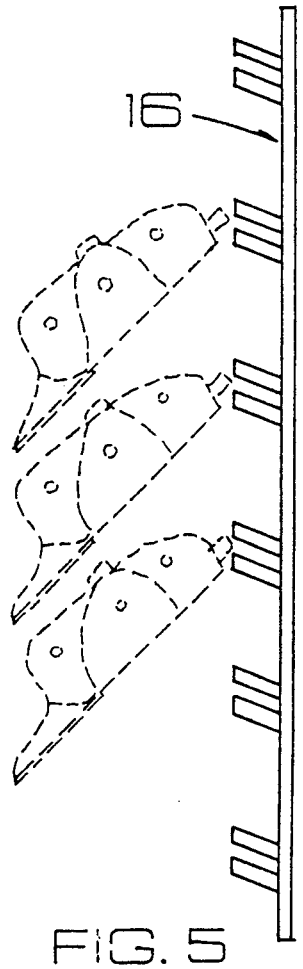
FIG. 5 is a view illustrating an accumulation of caps positioned on a multiple Cap Holder.

This invention contemplates the manufacture of separate cap holder units as well as a configuration of many units combined on a common base. As example, FIG. 5 illustrates such an embodiment of a multiple cap holder wherein several caps are being displayed on common vertical base 16 with each cap being restrained to allow good display and permit the removal and replacement of any cap without causing other caps to be dislodged.

Although the periphery of base 14 is approximately square in shape in the specific embodiment shown in FIG. 1, the periphery may assume any shape which is convenient. Similarly, the shapes of prongs 11, 12, and 13, as shown in FIG. 1 as being round, may assume any practical shape. The invention may be made of wood, plastic or other suitable material.

What is claimed is:

1. A cap holding device which comprises one or more groups of three prongs which protrude at an angle from a common base with two of the prongs being located horizontal to each other and the third prong protruding from the base at a point between the two prongs but slightly above them so that there exists a binding pressure against the cap band to enable restraint thereof.

* * * * *